US009750379B2

(12) United States Patent
Ryu

(10) Patent No.: US 9,750,379 B2
(45) Date of Patent: Sep. 5, 2017

(54) VACUUM CLEANER FOR VEHICLE MANUFACTURING PRODUCTION LINE

(71) Applicant: HYUNDAI MOTOR COMPANY, Seoul (KR)

(72) Inventor: Hyun Jung Ryu, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/879,038

(22) Filed: Oct. 8, 2015

(65) Prior Publication Data

US 2016/0324383 A1 Nov. 10, 2016

(30) Foreign Application Priority Data

May 8, 2015 (KR) ..... 10-2015-0064758

(51) Int. Cl.
*A47L 9/02* (2006.01)

(52) U.S. Cl.
CPC ..... *A47L 9/02* (2013.01)

(58) Field of Classification Search
CPC ..... A47L 9/00; A47L 9/22; A47L 9/28; A47L 5/24; A47L 5/242; A47L 9/06
See application file for complete search history.

(56) References Cited

U.S. PATENT DOCUMENTS 4,263,693 A * 4/1981 Mekelburg ..... A47L 9/08 15/322
5,276,940 A * 1/1994 Renaudin ..... E01H 8/00 15/345
5,983,446 A * 11/1999 Hsia ..... A47L 9/02 15/354
7,665,783 B2 * 2/2010 Nishio ..... B25B 11/005 294/188
2007/0214586 A1 * 9/2007 Mattucci ..... A46B 5/0054 15/4

FOREIGN PATENT DOCUMENTS

JP 2013-503047 1/2013
KR 10-2006-0126485 A 12/2006
KR 10-2010-0039948 A 4/2010
KR 10-1102440 B1 1/2012

* cited by examiner

*Primary Examiner* — Dung Van Nguyen
(74) *Attorney, Agent, or Firm* — McDermott Will & Emery LLP

(57) ABSTRACT

A vacuum cleaner includes a vacuum suction pipe through which impurities are collected together with air. A suction side plate has a central hole which corresponds with the vacuum suction pipe so that the vacuum suction pipe is fitted in the central hole. A holding plate is spaced apart from the suction side plate. A spring unit connects the suction side plate with the holding plate to elastically adjust a distance between the suction side plate and the holding plate.

13 Claims, 7 Drawing Sheets

VACUUM CLEANER FOR VEHICLE MANUFACTURING PRODUCTION LINE

CROSS-REFERENCE TO RELATED APPLICATION

This application claims the benefit of priority to Korean Patent Application No. 10-2015-0064758 filed in the Korean Intellectual Property Office on May 8, 2015, the entire content of which is incorporated herein by reference.

TECHNICAL FIELD

The present disclosure relates to a vacuum cleaner for a production line. More particularly, the present disclosure relates to a vacuum cleaner mounted on a manufacturing production line to collect or remove various pollutants generated from a product.

BACKGROUND

Generally, a vacuum cleaner, which applies an air pressure difference, is widely used not only for general homes but also for industrial fields where a large amount of pollutants are generated.

For example, in manufacturing a vehicle body, a cleaning system is provided on a production line.

The cleaning system removes various pollutants, such as dust, chips, spatters, and oil stains generated on a surface of the vehicle body as the vehicle body moves on the production line. The pollutants need to be removed firstly by the cleaning system because such pollutants cause painting error during a painting process.

In the cleaning system, a robot arm moves to contact the vacuum cleaner with the surface of the vehicle body while cleaning the vehicle body, so that scratch may be generated on the surface.

Thus, techniques on effectively alleviating occurrence of scratch and cleaning a bumpy or slanted bottom to increase work efficiency and to decrease a work cycle has been studied for improving overall productivity when a vacuum cleaner is used in a cleaning system.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a vacuum cleaner having advantages of improving a working environment and preventing occurrence of scratch by smoothly contacting a bumpy or slanted surface and easily collecting pollutants from the bumpy or the slanted surface.

A vacuum cleaner according to an exemplary embodiment may include a vacuum suction pipe through which impurities are collected together with air. A suction side plate has a central hole which corresponds with the vacuum suction pipe so that the vacuum suction pipe is fitted in the central hole. A holding plate is spaced apart from the suction side plate. A spring unit connects the suction side plate with the holding plate to elastically adjust a distance between the suction side plate and the holding plate. The vacuum suction pipe may be connected with the central hole to collect the impurities through the central hole of the suction side plate. The spring unit may be arranged along a circumference of the vacuum suction pipe.

The spring unit may include at least two spring units.

The spring unit may include a rod one having one end connected with the suction side plate through a ball joint and another end penetrating the holding plate. A stopper ring fixes the rod to the holding plate to prevent disengagement between the rod and the holding plate. An elastic member is disposed along the rod to vary the distance between the holding plate and the suction side plate. The elastic member may be a coil spring and surround an exterior of the rod.

The holding plate may be movably connected with a robot arm.

A suction pad may be formed of a rubber material and may be mounted to a lower side of the suction side plate along an external circumference.

The ball joint may include a ball housing fixed to the suction side plate; and a ball formed at the one end of the rod and inserted into the ball housing.

A vacuum cleaner according to another exemplary embodiment may include a vacuum suction pipe through which impurities are collected together with air. A suction side plate has a central hole which corresponds with the vacuum suction pipe so that the vacuum suction pipe is fitted in the central hole. A holding plate is spaced apart from the suction side plate. A rod has end connected with the suction side plate through a ball joint and another end portion penetrating the holding plate. A stopper ring fixes the rod to the holding plate to prevent disengagement between the rod and the holding plate. An elastic member is disposed along the rod to vary a distance between the holding plate and the suction side plate. The ball joint may include a ball housing fixed to the suction side plate; and a ball formed at the one end of the rod and inserted into the ball housing.

The ball housing may be arranged along a circumference of the vacuum suction pipe.

The vacuum suction pipe may collect the impurities through the central hole of the suction side plate.

A suction pad may be formed of an elastic material and may be mounted to a lower side of the suction side plate along an external circumference of the central hole. The suction pad may deflect according to a form of a contact surface.

DETAILED DESCRIPTION OF THE EMBODIMENTS

Figure 1:
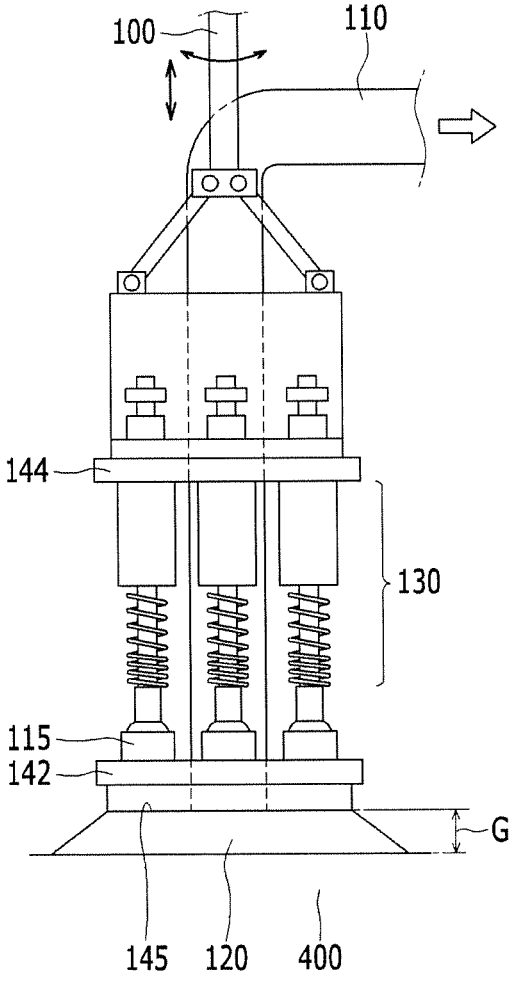
FIG. 1 is a schematic diagram of a vacuum cleaner according to an exemplary embodiment of the present inventive concept.

Hereinafter, an exemplary embodiment of the present inventive concept will be described in detail with reference to the accompanying drawings.

However, the size and thickness of each component illustrated in the drawings are arbitrarily shown for better understanding and ease of description, but the present disclosure is not limited thereto. Thicknesses are enlarged to clearly express various portions and areas.

FIG. 1 is a schematic diagram of a vacuum cleaner according to an exemplary embodiment of the present inventive concept.

Referring to FIG. 1, a vacuum cleaner includes a rubber suction pad 120, a suction side plate 142, a ball joint 115, a spring unit 130, a holding plate 144, a vacuum suction pipe 110, and a robot arm 100.

The robot arm 100 may move or rotate by a robot (not shown), or may move or rotate by a worker without the robot.

One end of the vacuum suction pipe 110 collects impurities together with air through the rubber suction pad 120 and the suction side plate 142. A filter (not shown) is disposed at another end of the vacuum suction pipe 110 to filter the impurities. The rubber suction pad 120 forms a gap between a lower surface of the suction side plate 142 and a bottom contact surface 400.

The spring unit 130 smoothly moves the suction side plate 142 with respect to the holding plate 144 such that the suction side plate 142 and the rubber suction pad 120 smoothly contact the bottom surface 400 which is slanted or bumpy.

In addition, the spring unit 130 smoothly varies a distance between the holding plate 144 and the suction side plate 142 such that impact is absorbed and occurrence of scratches on the bottom surface 400 is prevented in advance.

Figure 2A:
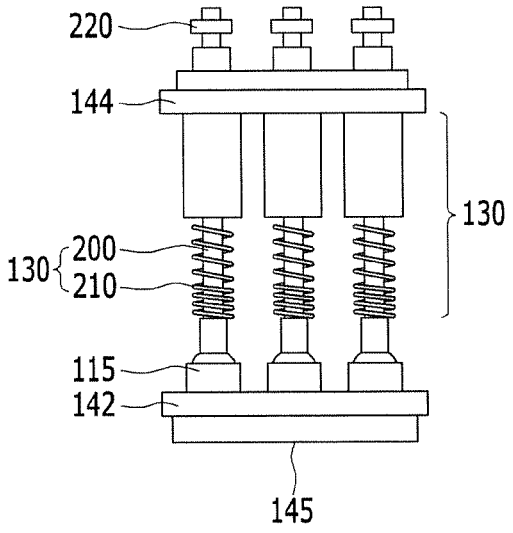
FIG. 2A is a side view of a vacuum cleaner according to an exemplary embodiment of the present inventive concept.

FIG. 2A is a side view of a vacuum cleaner according to an exemplary embodiment of the present inventive concept.

Referring to FIG. 2A, the spring unit 130 includes a rod 200 and a spring 210. A lower portion of the rod 200 is connected with an upper surface of the suction side plate 142 through the ball joint 115, and an upper portion of the rod 200 penetrates the holding plate 144. A stopper ring 220 is engaged to the upper portion of the rod 200.

The spring 210 is disposed on an external circumference of the rod 200 and elastically supports the holding plate 144 and the suction side plate 142 such that a distance between the holding plate 144 and the suction side plate 142 varies. The stopper ring 220 prevents the rod 200 from escaping from the holding plate 144. Here, the spring 210 may be a coil spring.

Figure 2B:
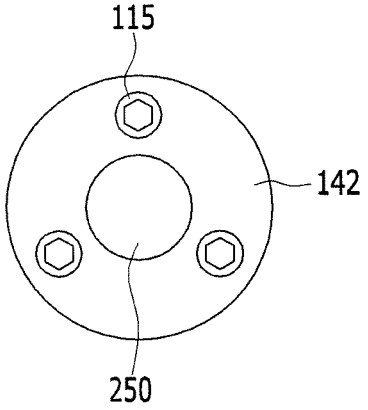
FIG. 2B a partial top plan view of a vacuum cleaner according to an exemplary embodiment of the present inventive concept.

FIG. 2B a partial top plan view of a vacuum cleaner according to an exemplary embodiment of the present inventive concept.

Referring to FIG. 2B, the suction side plate 142 has a circular shape such that a central hole 250 is formed at a central portion. The vacuum suction pipe 110 sucks impurities together with air through the central hole 250.

Three ball joints 115 are equally spaced apart on the upper surface of the suction side plate 142, and at least two or more specifically three spring units 130 are provided.

Figure 3:
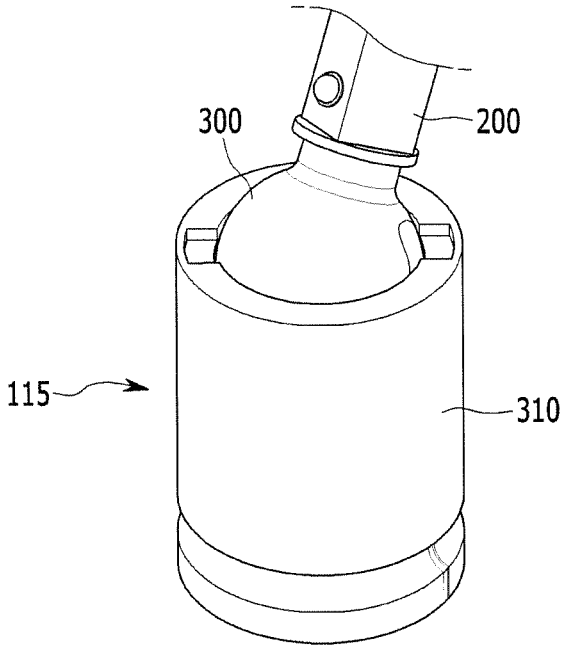
FIG. 3 is a partial perspective view of a ball joint in a vacuum cleaner according to an exemplary embodiment of the present inventive concept.

FIG. 3 is a partial perspective view of a ball joint in a vacuum cleaner according to an exemplary embodiment of the present inventive concept.

Referring to FIG. 3, the ball joint 115 includes a ball 300 which is formed at a lower end portion of the rod 200 and a ball housing 310 into which the ball 300 is inserted to swivel, and the ball housing 310 is fixed to the upper surface of the suction side plate 142.

Figure 4:
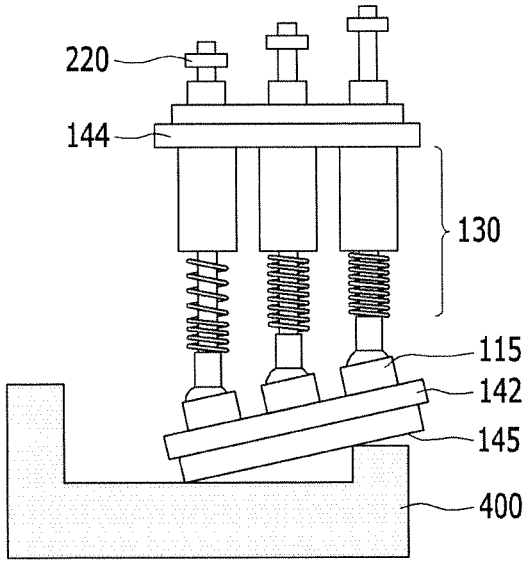
FIGS. 4-6 are side views showing a state of application of a vacuum cleaner according to an exemplary embodiment of the present inventive concept.
Figure 5:
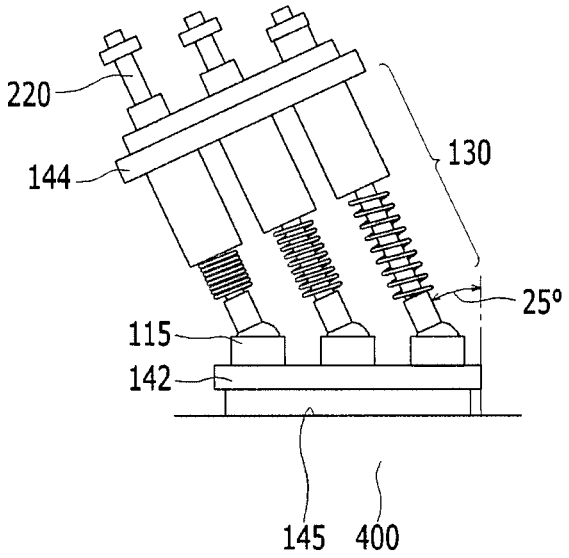
Figure 6:
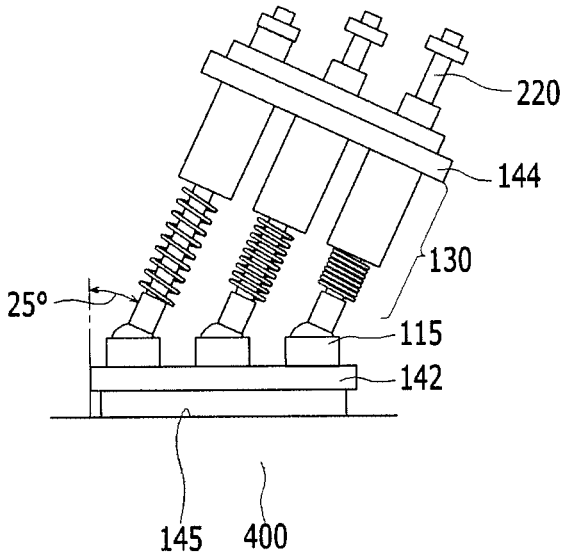

FIGS. 4-6 are side views showing a state of application of a vacuum cleaner according to an exemplary embodiment of the present inventive concept.

Referring to FIG. 4, when the suction side plate 142 passes the bottom surface 400 which is bumpy, one of the spring units 130 contracts and another one of the spring units 130 expands such that the suction side plate 142 is slanted so as to effectively clean the bumpy bottom surface 400.

Referring to FIG. 5, one of the spring units 130 contracts and another one of the spring units 130 expands such that the suction side plate 142 smoothly contacts the bottom surface 400 even though the bottom surface 400 is flat, and the robot arm 100 and the holding plate 144 are slanted with respect to the bottom surface 400.

Referring to FIG. 6, one of the spring units 130 contracts and another one of the spring units 130 expands such that the suction side plate 142 smoothly contacts the bottom surface 400 even though the robot arm 100 and the holding plate 144 are slanted with respect to the flat bottom surface 400.

According to an exemplary embodiment of the present inventive concept, the vacuum cleaner effectively removes and collects impurities on the bumpy or slanted bottom surface 400 as the suction side plate 142 and the rubber suction pad 120 are smoothly slanted with respect to each other through the spring unit 130.

In addition, the spring unit 130 easily expands and contracts by the rod 200 and the spring 210 mounted to the rod 200, and swivels by the ball joint 115 such that the vacuum cleaner effectively removes impurities on the surface.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. A vacuum cleaner, comprising:

a vacuum suction pipe through which impurities are collected together with air;

a suction side plate having a central hole which corresponds with the vacuum suction pipe so that the vacuum suction pipe is fitted in the central hole;

a holding plate spaced apart from the suction side plate; and a spring unit connecting the suction side plate with the holding plate to elastically adjust a distance between the suction side plate and the holding plate, wherein the spring unit comprises:

a rod having one end connected with the suction side plate through a ball joint and another end penetrating the holding plate;

a stopper ring fixing the rod to the holding plate to prevent disengagement between the rod and the holding plate; and an elastic member disposed along the rod to vary the distance between the holding plate and the suction side plate.

2. The vacuum cleaner of claim 1, wherein the vacuum suction pipe is connected with the central hole to collect the impurities through the central hole of the suction side plate.

3. The vacuum cleaner of claim 1, wherein the spring unit is arranged along a circumference of the vacuum suction pipe.

4. The vacuum cleaner of claim 3, wherein the spring unit includes at least two spring units.

5. The vacuum cleaner of claim 1, wherein the elastic member is a coil spring and surrounds an exterior of the rod.

6. The vacuum cleaner of claim 1, wherein the holding plate is movably connected with a robot arm.

7. The vacuum cleaner of claim 1, further comprising a suction pad formed of a rubber material and mounted to a lower side of the suction side plate along an external circumference.

8. The vacuum cleaner of claim 1, wherein the ball joint comprises:

a ball housing fixed to the suction side plate; and a ball formed at the one end of the rod and inserted into the ball housing.

9. A vacuum cleaner comprising:

a vacuum suction pipe through which impurities are collected together with air;

a suction side plate having a central hole which corresponds with the vacuum suction pipe so that the vacuum suction pipe is fitted in the central hole;

a holding plate spaced apart from the suction side plate;

a rod having one end connected with the suction side plate through a ball joint and another end penetrating the holding plate;

a stopper ring fixing the rod to the holding plate to prevent disengagement between the rod and the holding plate; and an elastic member disposed along the rod to vary a distance between the holding plate and the suction side plate.

10. The vacuum cleaner of claim 9, wherein the ball joint comprises:

a ball housing fixed to the suction side plate; and a ball formed at the one end of the rod and inserted into the ball housing.

11. The vacuum cleaner of claim 10, wherein the ball housing is arranged along a circumference of the vacuum suction pipe.

12. The vacuum cleaner of claim 10, wherein the vacuum suction pipe collects the impurities through the central hole of the suction side plate.

13. The vacuum cleaner of claim 9, further comprising a suction pad formed of an elastic material and mounted to a lower side of the suction side plate along an external circumference of the central hole, wherein the suction pad deflects according to a form of a contact surface.

* * * * *